US009181827B2

(12) United States Patent
Kim

(10) Patent No.: US 9,181,827 B2
(45) Date of Patent: Nov. 10, 2015

(54) VARIABLE VALVE LIFT APPARATUS

(71) Applicant: Hyundai Motor Company, Seoul (KR)

(72) Inventor: Sangyun Kim, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/336,617

(22) Filed: Jul. 21, 2014

(65) Prior Publication Data

US 2015/0167512 A1 Jun. 18, 2015

(30) Foreign Application Priority Data

Dec. 17, 2013 (KR) ..... 10-2013-0157574

(51) Int. Cl.
*F01L 1/34* (2006.01)
*F01L 13/00* (2006.01)

(52) U.S. Cl.
CPC ..... *F01L 13/0063* (2013.01)

(58) Field of Classification Search
CPC ..... F01L 13/0063
USPC ..... 123/90.15, 90.16, 90.39
See application file for complete search history.

(56) References Cited

U.S. PATENT DOCUMENTS 5,809,951 A * 9/1998 Kim ..... 123/90.16
6,722,326 B1 4/2004 Shui et al.

FOREIGN PATENT DOCUMENTS

| | | | |
|---|---|---|---|
| JP | 9-506402 | A | 6/1997 |
| KR | 10-0534184 | B1 | 12/2005 |
| KR | 10-0820694 | B1 | 4/2008 |
| KR | 10-1080779 | B1 | 11/2011 |
| WO | WO 95/08051 | A1 | 3/1995 |

* cited by examiner

*Primary Examiner* — Zelalem Eshete
(74) *Attorney, Agent, or Firm* — Morgan, Lewis & Bockius LLP

(57) ABSTRACT

A variable valve lift apparatus for changing a lift of an intake or exhaust valve in at least two stages may include a lever body, a piston, a cylinder, a hydraulic pressure chamber, an active portion, a hinge portion, a roller, a rotation shaft, a guide slot, a hydraulic pressure supply portion, and an elastic member, in which the lever body may make a lever motion at an end with the intake valve or the exhaust valve connected thereto, the piston may make reciprocal motion in the cylinder, the rotation shaft may pass through the hinge portion and the roller and be a rotation center of the roller, moving together with the roller, the hydraulic pressure supply portion may supply hydraulic pressure to the hydraulic pressure chamber for moving the piston, and the elastic member may return the piston if the hydraulic pressure being supplied to the hydraulic pressure chamber is removed.

12 Claims, 8 Drawing Sheets

VARIABLE VALVE LIFT APPARATUS

CROSS-REFERENCE TO RELATED APPLICATION

The present application claims priority to Korean Patent Application No. 10-2013-0157574 filed Dec. 17, 2013, the entire contents of which is incorporated herein for all purposes by this reference.

BACKGROUND OF THE INVENTION

1. Field of the Invention

The present invention relates to a variable valve lift apparatus. More particularly, the present invention relates to a variable valve lift apparatus which can change a valve lift with one cam.

2. Description of Related Art

In general, an internal combustion engine generates power by burning fuel and air received in a combustion chamber. In this case, when the air is to be drawn, an intake valve is put into action by driving a camshaft, to draw the air into the combustion chamber while the intake valve is opened. And, when the air is to be exhausted, an exhaust valve is put into action by driving the camshaft, to exhaust the air from the combustion chamber while the exhaust valve is opened.

In the meantime, optimum operation of the intake valve or the exhaust valve varies with an engine rotation speed. That is, an appropriate lift of a valve opening/closing timing is controlled according to the engine rotation speed. Thus, in order to embody an appropriate valve operation according to the engine rotation speed, a variable valve lift (VVL) apparatus is under research, for embodying the valve to operate at a lift varied with the engine rotation speed. As an example of the variable valve lift apparatus, there is a device having a plurality of cams provided to a cam shaft for driving a valve with lifts different from one another for selecting a cam to drive the valve according to a situation.

However, if the plurality of cams are provided to the cam shaft, a configuration of making selective change of the plurality of cams for operating the intake valve or the exhaust valve can become complicated and interferences among the elements in the configuration are bound to take place. If the plurality of cams are operated independently for preventing the interferences among the configuration elements from taking place, leading to requiring an element for operating each of the cams, a cost is liable to increase.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable valve lift apparatus having advantages of changing a valve lift with one cam, and more specifically a variable valve lift apparatus which can change a valve lift with one cam. The variable valve lift apparatus has a simple configuration and can minimize a power loss caused by friction with a cam.

In an aspect of the present invention, a variable valve lift apparatus for changing a lift of an intake or an exhaust valve in at least two stages may include a lever body having a fixed length for making a lever motion according to rotation of a cam, wherein a first end of the lever body may include the intake valve or the exhaust valve connected to the first end of the lever body, a piston slidably mounted in the lever body and making reciprocal motion in a length direction of the lever body, a cylinder fixedly-mounted to the lever body to slidably receive the piston therein for the piston to make the reciprocal motion within the cylinder, a hydraulic pressure chamber formed in the cylinder between an inside surface of the cylinder and the piston, an active portion slidably provided in the lever body and connected to the piston to reciprocate together with the piston, a hinge portion slidably arranged in the lever body and hingedly connected to the active portion, a roller rotatably connected to the hinge portion and selectively movable in the length direction of the lever body by the reciprocal motion of the piston, a rotation shaft provided to pass through the lever body, the hinge portion and the roller for being a rotation center of the roller and moving together with the roller, a guide slot formed in the lever body, wherein the rotation shaft is slidably mounted in the guide slot for guiding a movement of the rotation shaft, a hydraulic pressure supply portion selectively supplying hydraulic pressure to the hydraulic pressure chamber for moving the piston in a second end direction of the lever body, and an elastic member arranged in the lever body and elastically biasing the active portion toward a first end direction of the lever body for returning the piston to an original position when the hydraulic pressure being supplied to the hydraulic pressure chamber is removed.

The guide slot may have an arc shape having a circle center thereof the same with a rotation center of the cam.

A second end of the lever portion is pivotal such that, when the piston is put into operation, a high lift of the intake valve or the exhaust valve is embodied.

A first end of the lever body makes a downward lever motion with respect to the second end of the lever body in a state that the roller is moved in the second end direction of the lever body by the hydraulic pressure to embody the high lift of the intake valve.

The roller in the state that the roller is moved in the second end direction of the lever body is pushed by a lobe of the cam and causes the first end of the lever body to move down by a larger distance than a case before the roller is moved in the second end direction.

When the piston is returned by elastic force of the elastic member, a low lift of the intake valve or the exhaust valve is embodied.

A first end of the lever body makes a downward lever motion with respect to a second end of the lever body in a state that the roller is moved in the first end direction of the lever body to embody the low lift of the intake valve.

The roller in the state that the roller is moved in the first end direction of the lever body is pushed by a lobe of the cam and causes the first end of the lever body to move down by a smaller distance than the state where the roller is moved in the second end direction of the lever.

The cylinder may include a supply hole formed connected to the hydraulic pressure supply portion for supplying the hydraulic pressure to the hydraulic pressure chamber, a drain hole for draining the hydraulic pressure supplied to the hydraulic pressure chamber and used to move the piston to an outside of the hydraulic pressure chamber, and an overpressure preventive hole formed to prevent the hydraulic pressure in the hydraulic pressure chamber from rising excessively and to prevent the piston from moving excessively due to the rising excessively of the hydraulic pressure.

The hydraulic pressure used to operate the piston is drained through the drain hole as the piston is returned.

The overpressure preventive hole is closed by the piston when the piston is at the original position and opened for draining the hydraulic pressure from the hydraulic pressure chamber to the outside of the hydraulic pressure chamber before the piston moves excessively by the hydraulic pressure.

The roller is in rolling contact with the cam to convert a rotation of a camshaft to the lever motion of the lever body.

Other aspects and preferred embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention

Figure 1:
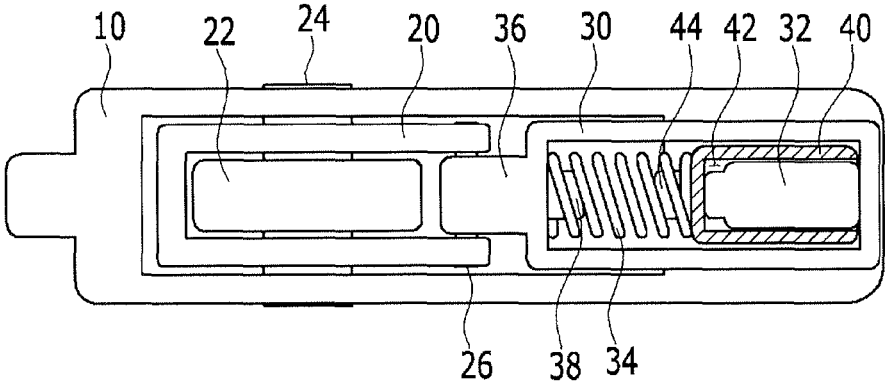
FIG. 1 illustrates a plan view of a variable valve lift apparatus according to an exemplary embodiment of the present invention.

Reference numerals set forth in the Drawings include reference to the following elements as further discussed below:

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an exemplary embodiment of the present invention will be described with reference to the accompanying drawings so that those skilled in the Field of the Invention to which the present invention pertains may carry out the exemplary embodiment.

FIG. 1 illustrates a plan view of a variable valve lift apparatus according to an exemplary embodiment of the present invention.

Referring to FIG. 1, the variable valve lift apparatus according to an exemplary embodiment of the present invention may include a lever body 10, a hinge portion 20, a roller 22, a rotation shaft 24, a hinge shaft 26, active portion 30, a piston 32, a cylinder 40, a hydraulic pressure chamber 42, and a spring 34.

Figure 3:
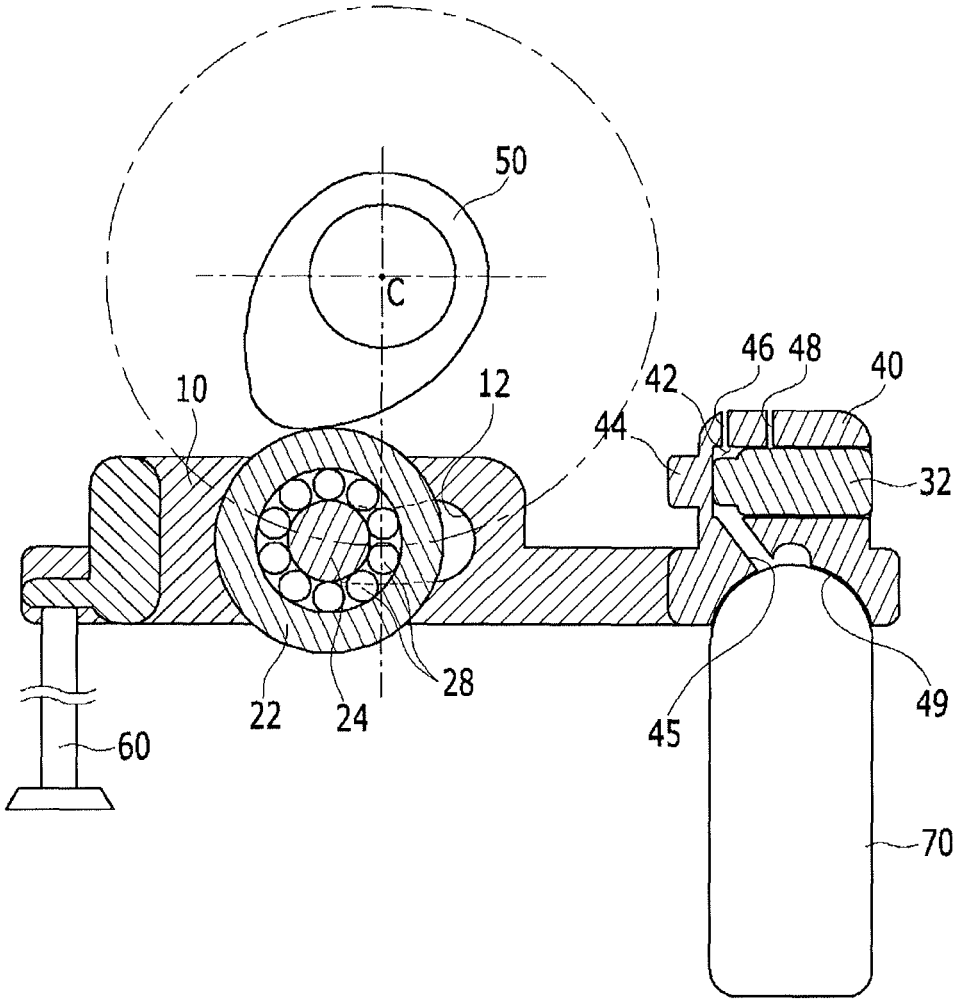
FIG. 3 illustrates a cross sectional view of a variable valve lift apparatus according to an exemplary embodiment of the present invention.

The lever body 10 receives a torque from a camshaft for making a lever motion, and being operated to open/close a valve 60 (See FIG. 3). The camshaft has a cam 50 formed on, or provided to, the cam shaft for converting rotation of the cam shaft to the lever motion of the lever body 10. In this case, the valve 60 is an intake valve or an exhaust valve of an engine. The lever body 10 has an inside space formed therein to have the lever body 10 passed therethrough in a vertical direction. That is, the lever body 10 has a fixed length to make the lever motion, and a fixed width and a fixed thickness to form the inside space of the lever body 10. The lever body 10 has a first end with the valve 60 connected thereto and a second end with a rotation shaft of the lever motion provided thereto.

In description hereinafter, a first end and a second end of each elements provided to the lever body 10 mean a portion on the same side with the first end and the second end of the lever body 10.

The hinge portion 20 is arranged in the inside space of the lever body 10. The hinge portion 20 may be formed to have a U shape with a closed end and an open end.

The roller 22 may be arranged in the U shape of the hinge portion 20. The roller 22 is rotatably connected to the hinge portion 20. The roller 22 is in rolling contact with the cam 50 to convert the rotation of the cam shaft to the lever motion of the lever body 10 (See FIG. 3).

The rotation shaft 24 is a cylindrical shaft which is a rotation center of the roller 22. The rotation shaft 24 is arranged to pass through the lever body 10, the hinge portion 20, and the roller 22 in a width direction of the lever body 10, rotatably connecting the hinge portion 20 and the roller 22.

The hinge shaft 26 is provided to the second end of the hinge portion 20. The hinge shaft 26 is a cylindrical shaft arranged to pass through the open end of the hinge portion 20 in a width direction of the lever body 10.

The active portion 30 is provided to the second end of the lever body 10 to be able to reciprocate in a length direction of the lever body 10.

The first end of the active portion 30 may be connected to the second end of the hinge portion 20. As the hinge shaft 26 is arranged to pass through the second end of the hinge portion 20 and a first end of the active portion 30 in a width direction of the lever body 10, the second end of the hinge portion 20 is hingedly connected to the first end of the active portion 30. The first end of the active portion 30 may be arranged, but not limited to, to be placed in the U shape of the hinge portion 20 so as to be passed through by the hinge shaft 26.

The active portion 30 has an inside space formed therein. The inside space of the active portion 30 may be a space through which the active portion 30 is passed through in a vertical direction, but not limited to this.

The piston 32 is arranged to be in contact with a side of a first end of the active portion 30 within the active portion 30. The piston 32 moves as one unit with the active portion 30. That is, the piston 32 is provided to be able to reciprocate together with the active portion 30 in a length direction of the lever body 10.

The cylinder 40 is mounted to the second end of the lever body 10 and may be formed to house the piston 32. The piston 32 is placed in the cylinder to be able to reciprocate within the cylinder 40. The cylinder 40 is arranged in the inside space of the active portion 30. The cylinder 40 may be formed to have a closed end and an open end. The piston 32 has the first end placed in the cylinder 40 through the open end thereof and the second end moving in/moving out to/from the open end of the cylinder 40 according to the reciprocation of the piston 32.

The hydraulic pressure chamber 42 is a space formed between a first end of the piston 32 and an inside surface of the cylinder 40. If a hydraulic pressure is supplied to the hydraulic pressure chamber 42 higher than a preset pressure, the piston 32 is pushed in a direction of the second end by the hydraulic pressure formed in the hydraulic pressure chamber 42.

The spring 34 is arranged in the inside space of the active portion 30. The spring 34 is interposed between the first end of the cylinder 40 and the inside surface of the active portion 30. The spring 34 is formed to push the first end of the cylinder 40 and the inside surface of the active portion 30 in both directions. Since the cylinder 40 is secured to the second end of the lever body 10, the spring 34 pushes the active portion 30 in the first end direction of the lever body 10. Therefore, if the hydraulic pressure is supplied to the hydraulic pressure chamber 42 lower than the preset pressure, the active portion 30 moves in a direction of the first end of the lever body together with the piston 32 by the spring 34. That is, the piston 32 returns to an original position by the spring 34.

In order to mount the first end of the spring 34 to the inside surface of the active portion 30 which is being pushed by the spring 34, there is an active portion protrusion 38 projected from the inside surface of the active portion 30. In order to mount the second end of the spring 34 to one end of the cylinder 40 which is being pushed by the spring 34, there is a cylinder protrusion 44 projected from the first end of the cylinder 40.

Figure 2:
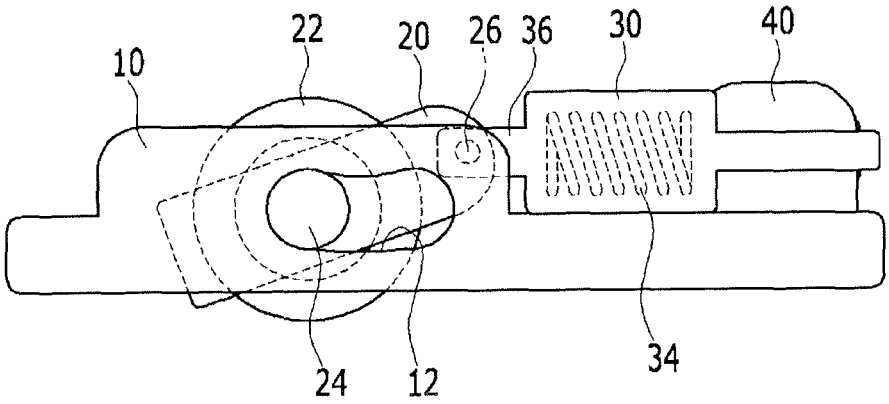
FIG. 2 illustrates a side view of a variable valve lift apparatus according to an exemplary embodiment of the present invention.

FIG. 2 illustrates a side view of a variable valve lift apparatus according to an exemplary embodiment of the present invention, and FIG. 3 illustrates a cross sectional view of a variable valve lift apparatus according to an exemplary embodiment of the present invention.

Referring to FIGS. 2 and 3, the lever body 10 has a guide slot 12 formed therein.

The guide slot 12 is formed to insert the rotation shaft 24 therein. That is, the rotation shaft 24 passes through the lever body 10 in a width direction thereof through the guide slot 12. According to the reciprocal motion of the piston 32 and the active portion 30, the hinge portion 20 hingedly connected to the active portion 30, and the roller 22 rotatably connected to the hinge portion 20, may move in the first end direction or the second end direction of the lever body 10. The guide slot 12 guides movement of the rotation shaft 24 which is at a center of the roller 22. Moreover, the guide slot 12 forms an arc which has the rotation center C of the cam 50 as a circle center of the arc, and the rotation shaft 24 moves along the arc of the guide slot 12. As the rotation shaft 24 moves along the arc, the hinge portion 20 rotatably connected to the rotation shaft 24 makes a hinge motion centered on the hinge shaft 26. For an example, if the rotation shaft 24 moves linearly along the length direction of the lever body 10, the hinge portion 20 will not make the hinge motion, and the hinge connection between the hinge portion 20 and the active portion 30 may not be required.

The cam 50 is formed to have a general cam shape in which an outside circumference of a cross section of the cam 50 is formed to have an oval shape with a first end projected more than a second end of the cam, relatively. In general, the first end of the cam 50 is called a lobe and the second end of the cam 50 is called a base.

The base of the cam 50 is a base circle of the cam 50 having an arc with a fixed radius within the outside circumference of the cam 50. In this case, the arc of the base is an arc having the rotation center C of the cam 50 as a circle center C of the arc. The lobe of the cam 50 is a portion of the outside circumference of the cam 50 which is pushing the roller 22 starting from beginning of opening of the valve 60 until the valve 60 is closed completely by the rotation of the cam 50.

Referring to FIG. 3, in some aspects of the present invention, the variable valve lift apparatus further includes a supply hole 45, a drain hole 46, an overpressure preventive hole 48, a hydraulic pressure supply portion 70, and a seating recess 49.

The supply hole 45 may be a hole formed in the cylinder 40 for supplying hydraulic pressure to the hydraulic pressure chamber 42.

The drain hole 46 is hole formed in the cylinder 40 for draining the hydraulic pressure supplied to the hydraulic pressure chamber 42 and used for operating the piston 32 to an outside of the hydraulic pressure chamber 42. The hydraulic pressure in the hydraulic pressure chamber 42 is drained through the drain hole 46 when the piston 32 is moving in an inserting direction in the cylinder 40. A portion of the hydraulic pressure can be drained from the hydraulic pressure chamber 42 to the outside of the hydraulic pressure chamber 42 through the supply hole 45, slowly and naturally. Owing to the drain hole 46 formed thus, return reactivity in which the piston 32 moves to an original position may be improved.

The overpressure preventive hole 48 is formed in the cylinder 40 for preventing the piston 32 from moving excessively due to excessive rise of the hydraulic pressure in the hydraulic pressure chamber 42. That is, the overpressure preventive hole 48 prevents connected portions of the active portion 30, the spring 34 and the piston 32 from breaking due to excessive hydraulic pressure rise in the hydraulic pressure chamber 42. And, the overpressure preventive hole 48 is closed when the piston is at the original position by the piston 32 and opened when the piston 32 is put into action. The overpressure preventive hole 48 is opened to drain the hydraulic pressure to an outside of the hydraulic pressure chamber 42 before the piston 32 moves excessively by the hydraulic pressure.

The hydraulic pressure supply portion 70 is a device for supplying the hydraulic pressure to the hydraulic pressure chamber 42 through the supply hole 45. The hydraulic pressure supply portion 70 may be a general hydraulic lash adjuster (HLA) which puts the variable valve lift apparatus into operation by supplying the hydraulic pressure. In this case, the hydraulic lash adjuster is a device for supplying the hydraulic pressure to operate the variable valve lift apparatus as well as making a valve lifter to move in close contact with the cam, of which detailed description will be omitted as the device is apparent to a person skilled in this field of art (hereinafter, a person of an ordinary skill in the art).

The seating recess 49 is a recess formed in the cylinder 40 or the lever body 10 for seating the hydraulic pressure supply portion 70 thereon. The seating recess 49 is in communication with the supply hole 45. Accordingly, the hydraulic pressure supply portion 70 seated on the seating recess 49 is connected to the supply hole 45.

Hereinafter, the operation of the variable valve lift apparatus according to an exemplary embodiment of the present invention will be described with reference to FIGS. 4 to 8.

Figure 4:
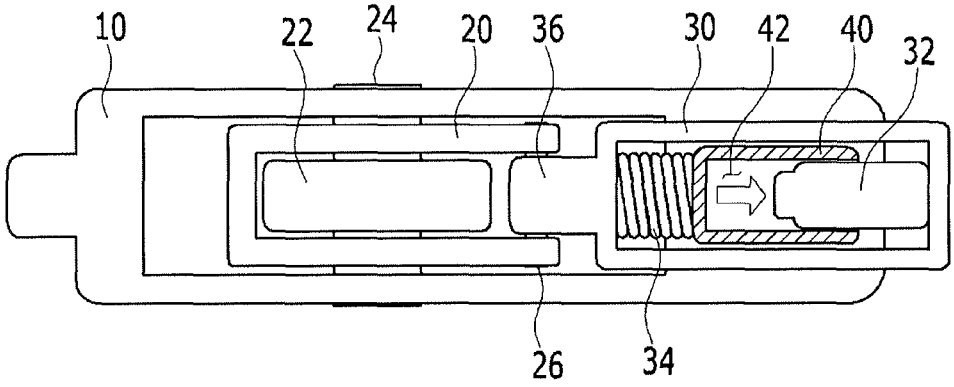
FIGS. 4 and 5 illustrate operation diagrams of a variable valve lift apparatus operated to embody a high lift according to an exemplary embodiment of the present invention.
Figure 5:
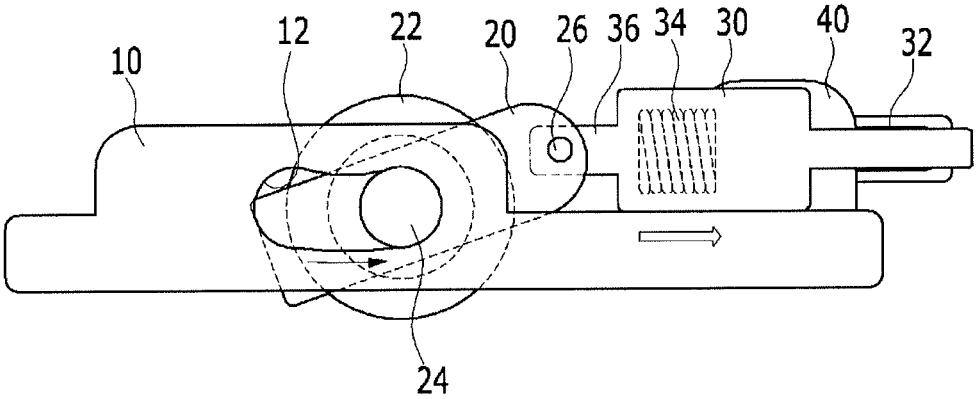

FIGS. 4 and 5 illustrate operation diagrams of a variable valve lift apparatus, operated to embody a high lift according to an exemplary embodiment of the present invention.

Referring to FIGS. 4 and 5, if the hydraulic pressure is supplied from the hydraulic pressure supply portion 70 to the hydraulic pressure chamber 42, the piston 32 is operated to move to the second end of the lever body 10. The piston 32 moves together with the active portion 30, and the roller 22 connected to the active portion 30 with the hinge portion 20 moves in the second end direction of the lever body 10.

If the lever body 10 makes the lever motion in a state the roller 22 is moved in the second end direction of the lever body 10, a high lift of the valve 60 is embodied.

If the roller 22 is moved in the second end direction of the lever body 10 in a state the rotation shaft of the lever motion provided to the second end of the lever body 10 is fixed, the first end of the lever body 10, moving down as the roller 22 is pushed by the lobe of the cam 50, moves down by a larger distance than a case before the roller 22 is moved. According to this, the high lift of the valve 60 connected to the first end of the lever body 10 is embodied.

Figure 6:
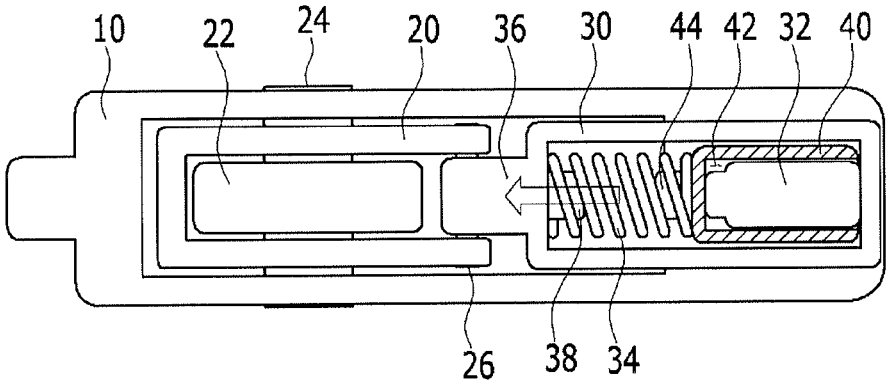
FIGS. 6 and 7 illustrate operation diagrams of a variable valve lift apparatus operated to embody a low lift, according to an exemplary embodiment of the present invention
Figure 7:
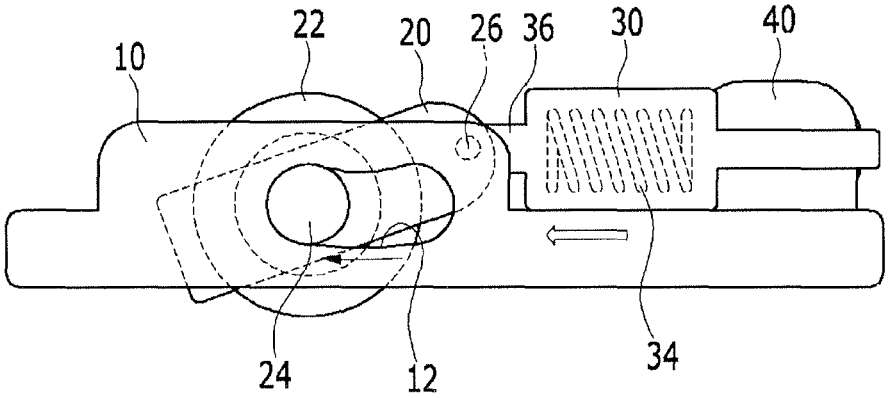

FIGS. 6 and 7 illustrate operation diagrams of a variable valve lift apparatus, operated to embody a low lift according to an exemplary embodiment of the present invention.

Referring to FIGS. 6 and 7, if the hydraulic pressure supplied to the hydraulic pressure chamber 42 from the hydraulic pressure supply portion 70 is removed, the piston 32 moves to the first end direction of the lever body 10 and is returned to an original position. The piston 32 moves together with the active portion 30, and the roller 22 connected to the active portion 30 with the hinge portion 20 is moved in the first end direction of the lever body 10 along the guide slot 12.

If the lever body 10 makes the lever motion in a state the roller 22 is moved in the first end direction of the lever body 10, a low lift of the valve 60 is embodied.

If the roller 22 is moved in the first end direction of the lever body 10 in a state the rotation shaft of the lever motion provided to the other end of the lever body 10 is fixed, the first end of the lever body 10, moving down as the roller 22 is pushed by the lobe of the cam 50, moves down by a smaller distance than a state the roller 22 is moved in the second end direction. According to this, the low lift of the valve 60 connected to one end of the lever body 10 is embodied.

Since the base of the cam 50 and the guide slot 12 are formed in arcs which have a circle center the same with the rotation center C, if the roller 22 moves while the roller 22 is in rolling contact with the base of the cam 50, the lever body 10 does not make the lever motion by the movement of the roller 22.

Figure 8:
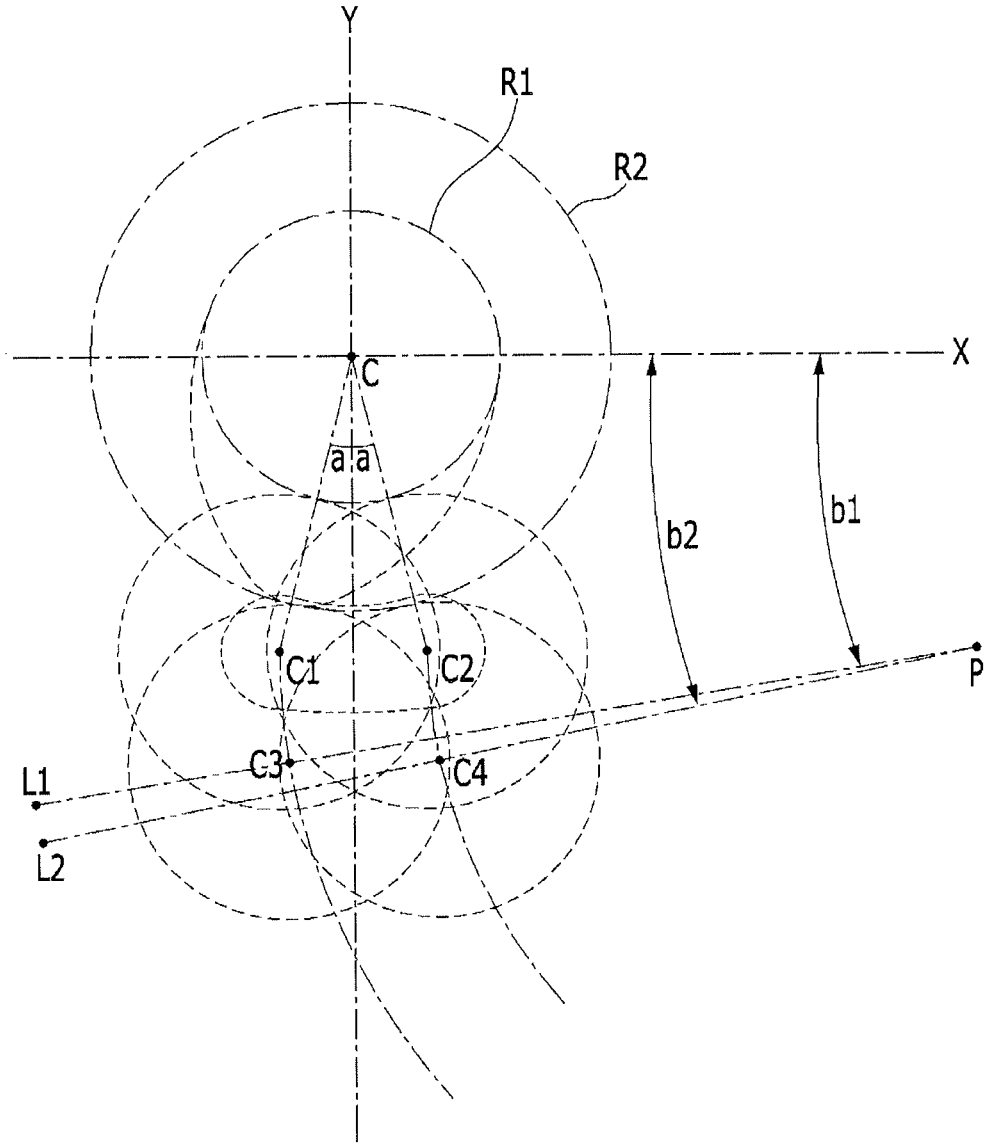
FIG. 8 illustrates a schematic view for a visualized comparison of a high lift and a low lift of a valve according to an exemplary embodiment of the present invention.

FIG. 8 illustrates a schematic view for a visualized comparison of a high lift and a low lift of a valve according to an exemplary embodiment of the present invention.

In FIG. 8, the arc of the guide slot 12, the outside circumference of the roller 22, and the outline of the lobe of the cam 50 are shown in dotted lines, and imaginary lines for visual comparison of the high lift and the low lift of the valve 60 are shown in alternate long and short dash lines.

As shown in FIG. 8, an included angle a between a bisector Y passing through the rotation center C while bisecting the arc of the guide slot 12 and a line extended from the rotation center C of the cam 50 to a center C1 of the roller 22 brought into contact with the cam 50 base before the low lift of the valve 60 is performed is the same with an included angle a between the bisector Y and a line extended from the rotation center C of the cam 50 to the center C2 of the roller 22 brought into contact with the cam 50 base before the high lift of the valve 60 is performed.

If the low lift of the valve 60 is performed as the roller 22 positioned at the center C1 is pushed by the cam 50 lobe, the roller 22 moves down from a point where the outside circumference of the roller 22 is in contact with a rotation track R1 of the cam 50 base to a point where the outside circumference of the roller 22 is in contact with a rotation track R2 at an end of the cam 50 lobe. In this case, the roller 22 makes a circular motion centered on a lever motion rotation axis P of the lever body 10.

The first end L1 of the lever body 10 moved down to embody the low lift of the valve 60 is positioned on an extension line of a line connecting the lever motion rotation axis P of the lever body 10 to a center C3 of the roller 22 moved down to the point the outside circumference of the roller 22 is in contact with the rotation track R2 at the end of the cam 50 lobe while embodying the low lift of the valve 60.

If the high lift of the valve 60 is performed as the roller 22 positioned at the center C2 is pushed by the cam 50 lobe, the roller 22 moves down from a point where the outside circumference of the roller 22 is in contact with the rotation track R1 of the cam 50 base to a point where the outside circumference of the roller 22 is in contact with the rotation track R2 of the end of the cam 50 lobe. In this case, the roller 22 makes a circular motion centered on the lever motion rotation axis P of the lever body 10.

The first end L2 of the lever body 10 moved down to embody the high lift of the valve 60 may be positioned on an extension line of a line connecting the lever motion rotation axis P of the lever body 10 to a center C4 of the roller 22 moved down to the point the outside circumference of the roller 22 is in contact with the rotation track R2 at the end of the cam 50 lobe while embodying the high lift of the valve 60.

A distance from a reference line X, perpendicular to the bisector Y, to the first end L1 of the lever body 10 moved down to embody the low lift of the valve 60, is shorter than a distance from the reference line X to one end L2 of the lever body 10 moved down to embody the high lift of the valve 60. FIG. 8 illustrates that an included angle b1 between a line passing through the P, C3, and L1 and the reference line X is smaller than an included angle b2 between a line passing through the P, C4, and L2 and the reference line X.

It has been described that the variable valve lift apparatus operates in, but is not limited to, two stages for embodying the high lift or the low lift of the valve 60. In other words, if a device, such as an oil control valve, is applied to the variable valve lift apparatus of the present invention for controlling intensity of the hydraulic pressure supplied to the hydraulic pressure chamber 42, it is possible to change the lift of the valve 60 to have multi-stages of three of more than three stages.

Thus, due the change of the valve lift according to movement of the roller 22 in rolling contact with a cam 50, the power loss caused by friction with the cam 50 can be minimized. Since the piston 32 is operated by the hydraulic pressure, and the active portion 30 moving together with the piston 32 is connected to the roller 22, a configuration of the variable valve lift apparatus of the present invention becomes simple and a cost thereof can be saved. Moreover, the small number of components and the simple configuration of the variable valve lift apparatus of the present invention permit a reduction of weight thereof and can improve a life time period.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus for changing a lift of an intake or an exhaust valve in at least two stages comprising:

a lever body having a fixed length for making a lever motion according to rotation of a cam, wherein a first end of the lever body includes the intake valve or the exhaust valve connected to the first end of the lever body;

a piston slidably mounted in the lever body and making reciprocal motion in a length direction of the lever body;

a cylinder fixedly-mounted to the lever body to slidably receive the piston therein for the piston to make the reciprocal motion within the cylinder;

a hydraulic pressure chamber formed in the cylinder between an inside surface of the cylinder and the piston;

an active portion slidably provided in the lever body and connected to the piston to reciprocate together with the piston;

a hinge portion slidably arranged in the lever body and hingedly connected to the active portion;

a roller rotatably connected to the hinge portion and selectively movable in the length direction of the lever body by the reciprocal motion of the piston;

a rotation shaft provided to pass through the lever body, the hinge portion and the roller for being a rotation center of the roller and moving together with the roller;

a guide slot formed in the lever body, wherein the rotation shaft is slidably mounted in the guide slot for guiding a movement of the rotation shaft;

a hydraulic pressure supply portion selectively supplying hydraulic pressure to the hydraulic pressure chamber for moving the piston in a second end direction of the lever body; and an elastic member arranged in the lever body and elastically biasing the active portion toward a first end direction of the lever body for returning the piston to an original position when the hydraulic pressure being supplied to the hydraulic pressure chamber is removed.

2. The variable valve lift apparatus of claim 1, wherein the guide slot has an arc shape having a circle center thereof the same with a rotation center of the cam.

3. The variable valve lift apparatus of claim 1, wherein a second end of the lever portion is pivotal such that, when the piston is put into operation, a high lift of the intake valve or the exhaust valve is embodied.

4. The variable valve lift apparatus of claim 3, wherein a first end of the lever body makes a downward lever motion with respect to the second end of the lever body in a state that the roller is moved in the second end direction of the lever body by the hydraulic pressure to embody the high lift of the intake valve.

5. The variable valve lift apparatus of claim 4, wherein the roller in the state that the roller is moved in the second end direction of the lever body is pushed by a lobe of the cam and causes the first end of the lever body to move down by a larger distance than a case before the roller is moved in the second end direction.

6. The variable valve lift apparatus of claim 1, wherein, when the piston is returned by elastic force of the elastic member, a low lift of the intake valve or the exhaust valve is embodied.

7. The variable valve lift apparatus of claim 6, wherein a first end of the lever body makes a downward lever motion with respect to a second end of the lever body in a state that the roller is moved in the first end direction of the lever body to embody the low lift of the intake valve.

8. The variable valve lift apparatus of claim 7, wherein the roller in the state that the roller is moved in the first end direction of the lever body is pushed by a lobe of the cam and causes the first end of the lever body to move down by a smaller distance than the state where the roller is moved in the second end direction of the lever.

9. The variable valve lift apparatus of claim 1, wherein the cylinder includes:

a supply hole formed connected to the hydraulic pressure supply portion for supplying the hydraulic pressure to the hydraulic pressure chamber;

a drain hole for draining the hydraulic pressure supplied to the hydraulic pressure chamber and used to move the piston to an outside of the hydraulic pressure chamber; and an overpressure preventive hole formed to prevent the hydraulic pressure in the hydraulic pressure chamber from rising excessively and to prevent the piston from moving excessively due to the rising excessively of the hydraulic pressure.

10. The variable valve lift apparatus of claim 9, wherein the hydraulic pressure used to operate the piston is drained through the drain hole as the piston is returned.

11. The variable valve lift apparatus of claim 9, wherein the overpressure preventive hole is closed by the piston when the piston is at the original position and opened for draining the hydraulic pressure from the hydraulic pressure chamber to the outside of the hydraulic pressure chamber before the piston moves excessively by the hydraulic pressure.

12. The variable valve lift apparatus of claim 1, wherein the roller is in rolling contact with the cam to convert a rotation of a camshaft to the lever motion of the lever body.

* * * * *